US011205539B2

(12) United States Patent
Jung et al.

(10) Patent No.: US 11,205,539 B2
(45) Date of Patent: Dec. 21, 2021

(54) COIL COMPONENT

(71) Applicant: SAMSUNG ELECTRO-MECHANICS CO., LTD., Suwon-si (KR)

(72) Inventors: Ji Hyung Jung, Suwon-si (KR); Boum Seock Kim, Suwon-si (KR); Kang Wook Bong, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 331 days.

(21) Appl. No.: 15/982,269

(22) Filed: May 17, 2018

(65) Prior Publication Data

US 2018/0358171 A1 Dec. 13, 2018

(30) Foreign Application Priority Data

Jun. 13, 2017 (KR) ..... 10-2017-0074202
Oct. 31, 2017 (KR) ..... 10-2017-0143076

(51) Int. Cl.

| | |
|---|---|
| ***H01F 17/00*** | (2006.01) |
| ***H01F 27/32*** | (2006.01) |
| ***H01F 5/06*** | (2006.01) |
| ***H01F 5/04*** | (2006.01) |
| ***H01F 27/30*** | (2006.01) |
| ***H01F 27/29*** | (2006.01) |
| ***H01F 17/04*** | (2006.01) |

(52) U.S. Cl.

CPC ..... *H01F 27/32* (2013.01); *H01F 5/04* (2013.01); *H01F 5/06* (2013.01); *H01F 17/0013* (2013.01); *H01F 17/04* (2013.01); *H01F 27/292* (2013.01); *H01F 27/30* (2013.01); *H01F 27/323* (2013.01); *H01F 27/324* (2013.01); *H01F 2017/048* (2013.01)

(58) Field of Classification Search

CPC ... H01F 27/32; H01F 5/06; H01F 5/04; H01F 27/30; H01F 27/292; H01F 27/2804
USPC ..... 336/200, 232
See application file for complete search history.

(56) References Cited

U.S. PATENT DOCUMENTS

2009/0085708 A1* 4/2009 Matsumoto ..... H01F 17/0013 336/200
2011/0133881 A1 6/2011 Nakajima et al.
(Continued)

FOREIGN PATENT DOCUMENTS

CN 105097258 A 11/2015
CN 105448503 A 3/2016
(Continued)

OTHER PUBLICATIONS

Office Action issued in Japanese Application No. 2018-093882 dated Oct. 23, 2018, with English translation.
(Continued)

*Primary Examiner* — Tszfung J Chan
(74) *Attorney, Agent, or Firm* — Morgan, Lewis & Bockius LLP

(57) ABSTRACT

A coil component includes a coil and external electrodes electrically connected to the coil. The coil may include a plurality of coil patterns. A distal end of an outermost coil pattern may include a gap filling portion. A through via directly connected to an innermost coil pattern may also include a gap filling portion.

24 Claims, 9 Drawing Sheets

(56) References Cited

U.S. PATENT DOCUMENTS

| | | | | |
|---|---|---|---|---|
| 2013/0249662 | A1* | 9/2013 | Tonoyama | H01F 17/0013 336/200 |
| 2014/0062638 | A1* | 3/2014 | Sasamori | H01F 27/2847 336/175 |
| 2015/0035634 | A1* | 2/2015 | Nakamura | H01F 41/046 336/170 |
| 2016/0049237 | A1 | 2/2016 | Yosui | |
| 2016/0099100 | A1* | 4/2016 | Park | H01F 17/0013 336/200 |
| 2016/0104563 | A1* | 4/2016 | Jeong | H01F 17/06 336/192 |
| 2016/0163444 | A1 | 6/2016 | Choi et al. | |
| 2016/0189840 | A1 | 6/2016 | Ahn et al. | |
| 2016/0293320 | A1 | 10/2016 | Kim et al. | |

FOREIGN PATENT DOCUMENTS

| | | | | |
|---|---|---|---|---|
| CN | 105742035 | A | | 7/2016 |
| JP | 11-204337 | | | 7/1999 |
| JP | 2001-185426 | A | | 7/2001 |
| JP | 2009295927 | A | * | 12/2009 |
| JP | 2010-287722 | A | | 12/2010 |
| JP | 2010287722 | A | * | 12/2010 |
| JP | 5281090 | B2 | | 9/2013 |
| JP | 2015-32625 | A | | 2/2015 |
| JP | 2015-35464 | A | | 2/2015 |
| JP | 2015035464 | A | * | 2/2015 |
| JP | 2015-216336 | A | | 12/2015 |
| KR | 20150127490 | A | * | 11/2015 |
| KR | 10-2016-0043796 | A | | 4/2016 |
| KR | 10-1693749 | B1 | | 1/2017 |
| WO | 2015/005161 | A1 | | 1/2015 |

OTHER PUBLICATIONS

Office Action issued in Korean Patent Application No. 10-2017-0143076 dated Dec. 7, 2018, with English translation.

First Office Action issued in Chinese Patent Application No. 201810599593.6 dated Jan. 8, 2020 (With English Translation).

* cited by examiner

I-I'

II-II'

COIL COMPONENT

CROSS-REFERENCE TO RELATED APPLICATION(S)

This application claims benefit of priority to Korean Patent Application Nos. 10-2017-0074202 filed on Jun. 13, 2017 and 10-2017-0143076 filed on Oct. 31, 2017 in the Korean Intellectual Property Office, the disclosure of which is incorporated herein by reference in its entirety.

BACKGROUND

1. Field

The present disclosure relates to a coil component, and more particularly, to a thin-film type power inductor.

2. Description of Related Art

In accordance with the recent development of portable wireless communications devices and wearable devices, components having high performance, a slim thickness, and a small size have been required. Particularly, recent portable smartphones and wearable devices operate at a higher frequency, and there is a need to stably supply power in a higher range of operating frequencies. Therefore, a power inductor used to suppress rapid changes in current at a power supply terminal has needed to be usable at a high frequency and high current.

In a thin film type power inductor according to the related art, a gap may exist between coil patterns, and magnetic particles may infiltrate into the gap. Insulation may be damaged by the infiltrated particles (which are conductive materials) at a high frequency and a high current, which may increase the possibility of a short-circuit and consequently affect product reliability.

SUMMARY

An aspect of the present disclosure may provide a coil component capable of improving product reliability. The coil component may have coil patterns of which structures are changed so as to prevent metal magnetic particles from infiltrating into a space between the coil patterns.

According to an aspect of the present disclosure, a coil component may include a coil including a plurality of coil patterns connected to each other to form an entirely spiral shape and a lead portion at an end portion of an outermost coil pattern. An external electrode may be connected to the lead portion. The distal end of the outermost coil pattern may include a gap filling portion formed of a conductive material. The gap filling portion may be spaced apart from an inward coil pattern by substantially the same distance by which the outermost coil pattern is spaced apart from the inward coil pattern.

According to another aspect of the present disclosure, a coil component may include a coil including a plurality of coil patterns connected to each other to form an entirely spiral shape and at least one through via directly connected to an innermost coil pattern among the plurality of coil patterns. There may be a gap filling portion at the through via and formed of a conductive material. The gap filling portion may be spaced apart from an outward coil pattern by substantially the same distance by which the innermost coil pattern is spaced apart from the outward coil pattern.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Coil components according to exemplary embodiments in the present disclosure will be described, but are not necessarily limited thereto.

Figure 1:
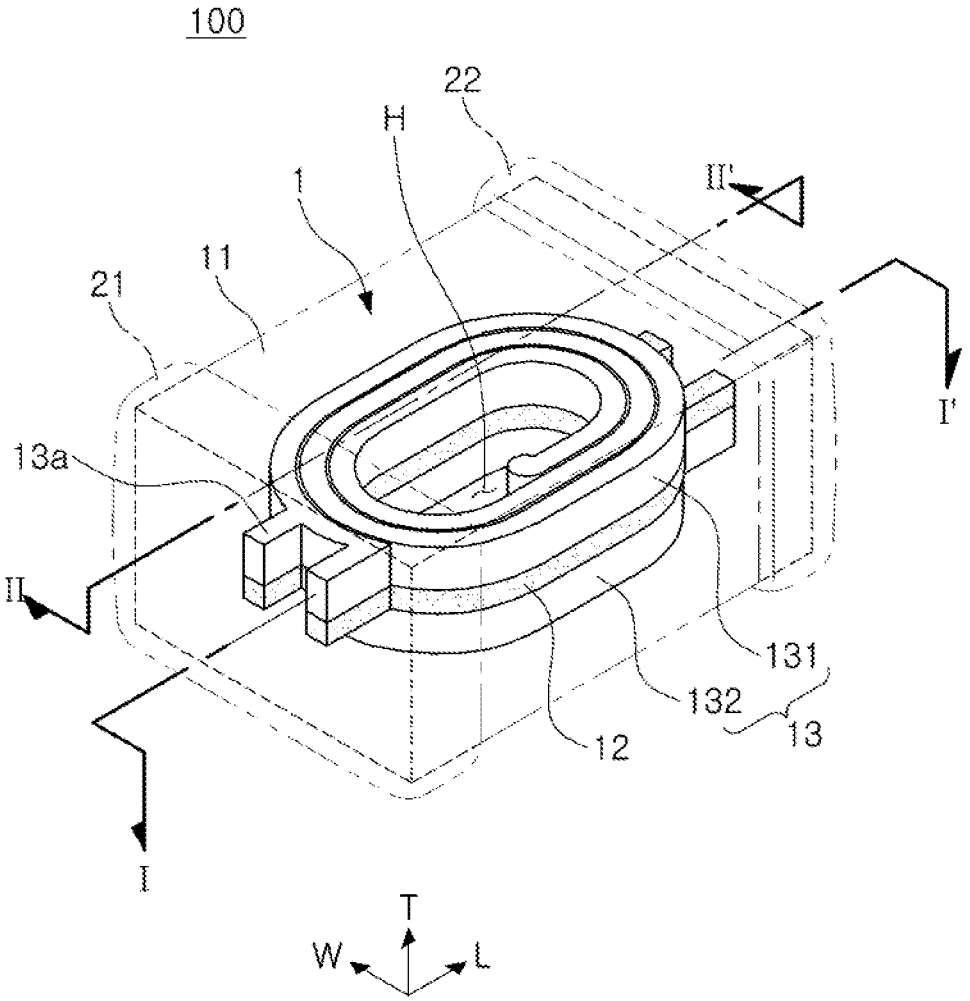
FIG. 1 is a schematic perspective view of a coil component according to a first exemplary embodiment in the present disclosure.
Figure 2:
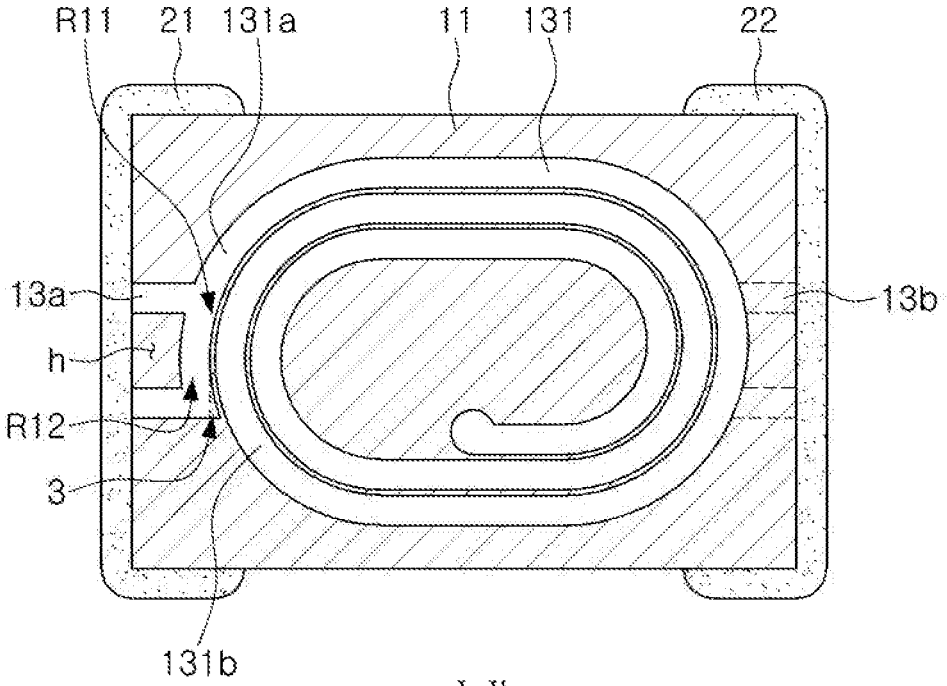
FIG. 2 is a schematic plan view of a coil pattern of the coil component of FIG. 1, based on a plane in a length-width (L-W) direction and taken along line I-I' of FIG. 1.
Figure 3:
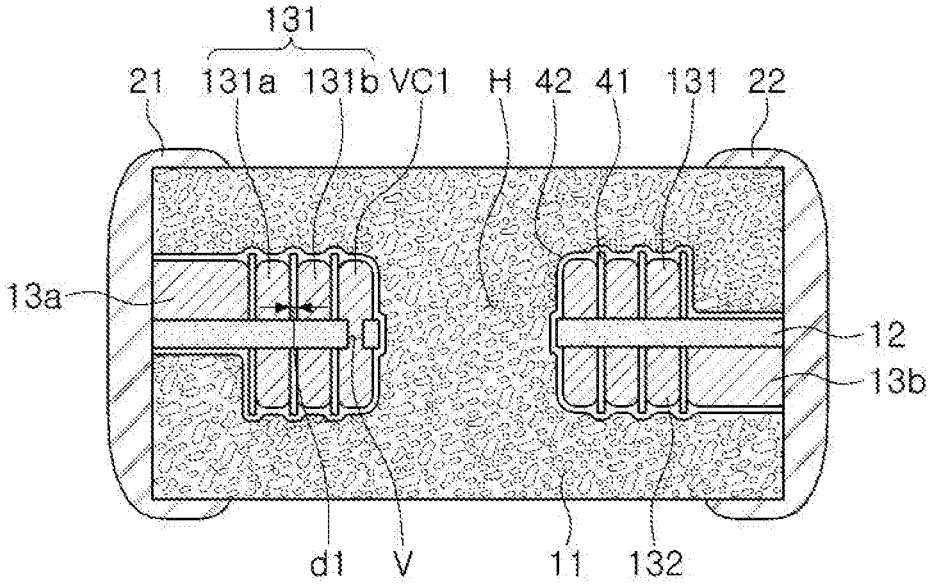
FIG. 3 is a schematic cross-sectional view taken along line II-II' of FIG. 1.

FIG. 1 is a schematic perspective view of a coil component 100 according to a first exemplary embodiment in the present disclosure. FIG. 2 is a schematic plan view of a coil pattern of the coil component of FIG. 1, based on a plane in a length-width (L-W) direction and taken along line I-I' of FIG. 1. FIG. 3 is a cross-sectional view taken along line II-II' of FIG. 1.

Referring to FIGS. 1 through 3, the coil component 100 according to the present disclosure may include a body 1 containing a magnetic material 11 and first and second external electrodes 21 and 22 disposed on outer surfaces of the body.

The first and second external electrodes 21 and 22 may be formed of a conductive material and serve to electrically connect a coil in the body 1 to external electronic components. The first external electrode 21 may be connected to a first lead portion 13*a* of one end portion of a coil 13 in the body 1, and the second external electrode 22 may be connected to a second lead portion 13*b* of the other end portion of the coil 13.

The shape of the first and second external electrodes may have a substantially "C" shape as illustrated in FIG. 1 or may have an "L" shape where it does not extend on an upper surface of the body. However, the shape of the first and second external electrodes is not limited thereto.

The body 1 may form an exterior of the coil component. The body may have upper and lower surfaces opposing each other in a thickness (T) direction, first and second end surfaces opposing each other in a length (L) direction, and first and second side surfaces opposing each other in a width (W) direction, and may have a substantially hexahedral shape. However, the shape of the body is not limited thereto.

The body 1 may contain a magnetic material 11. For example, the body 1 may be formed by filling a ferrite material or a metal based soft magnetic material. The ferrite may include, for example, Mn—Zn based ferrite, Ni—Zn based ferrite, Ni—Zn—Cu based ferrite, Mn—Mg based ferrite, Ba based ferrite, Li based ferrite, or the like. The metal based soft magnetic material may be an alloy containing one or more selected from the group consisting of Fe, Si, Cr, Al, Ni, B, Nb, and Cu. For example, the metal based soft magnetic material may contain Fe—Si—B—Cr based amorphous metal particles, but is not limited thereto. The metal based soft magnetic material may have a particle diameter of 0.1 μm or more to 20 μm or less and be contained in a form in which the metal based soft magnetic material is dispersed in a polymer such as an epoxy resin, polyimide, or the like.

A support member 12 may be disposed in the body 1 and encapsulated by the magnetic material 11. The support member 12 may include a central through hole "H," which may be filled with the magnetic material. Since the through hole is filled with a magnetic material having high permeability to form a magnetic core, the through hole may serve to improve permeability of a coil. The support member may include a via hole "V" spaced apart from the through hole and in addition to the through hole. The via hole may be filled with a conductive material to form a through via VC1. The through via VC1 may serve to electrically connect upper and lower coils 131 and 132, supported by the support member, to each other.

The coil 13 is supported by the support member 12 and may include the upper coil 131 in contact with an upper surface of the support member and the lower coil 132 in contact with a lower surface of the support member. The upper and lower coils may be electrically connected to each other through the through via VC1. Each of the upper and lower coils may have a spiral shape, and the upper and lower coils may be symmetrical to each other. For convenience of explanation, the upper coil will be described and the description may be applied to the lower coil.

The upper coil 131 may include a plurality of coil patterns 131*a* and 131*b*. The plurality of coil patterns may be connected to each other to implement an entirely spiral shape.

The numbers of turns, line widths, and aspect ratios (ARs) of the plurality of coil patterns may be suitably selected as needed, and is not specifically limited.

Each of the plurality of coil patterns may at least partially include a curved portion, when viewed as a plane in the length-width (L-W) direction, and the radius of curvature of the curved portion of the each of the coil patterns may be substantially constant through the curved portion. By having the radius of curvature of the curved portion be substantially constant, the spaced distance between adjacent coil patterns may be substantially constant through the curved portion.

Among the plurality of coil patterns, an outermost coil pattern 131*a* may be connected to the first lead portion 13*a* of the coil. The first lead portion 13*a* may include a penetration portion "h" in the center thereof, which may be filled with magnetic material. Including the penetration portion in the first lead portion may prevent over-plating of the first lead portion, may decrease thickness deviation of the coil, and may decrease DC resistance (Rdc).

The outermost coil pattern 131*a* may include a gap filling portion 3 at a distal end thereof connected to the first lead portion 13*a*. The gap filling portion 3 may be formed of a conductive material and be substantially integrated with the outermost coil pattern. The gap filling portion 3 may serve to remove a spare space between adjacent coil patterns so as to prevent the insulating layer enclosing the coil patterns from being damaged by the magnetic particles of the magnetic material which would otherwise fill the spare space. The spaced distance dl between the outermost coil pattern and a first coil pattern 131*b* most adjacent thereto may be maintained in a winding direction of the coil due to the gap filling portion.

The radiuses of curvature R11 and R12 of the curved portion in the outermost coil pattern, where it connects to the first lead portion 13*a*, may be substantially equal to each other. As described above, since the radius of curvature of the curved portion is substantially constant, the spare space between adjacent coil patterns may be removed or minimized. Therefore, there may be insufficient space between coil patterns into which magnetic particles of the magnetic material may infiltrate. As such, the possibility of infiltration of the magnetic particles may be prevented in advance.

The radius of curvature of the outermost coil pattern may be substantially constant in the winding direction of the coil, and the interval between the outermost coil pattern and the first coil pattern adjacent thereto may be substantially constant. This is due to the outermost coil pattern including a gap filling portion 3 formed integrally with the distal end of the outermost coil pattern. The gap filling portion may fill the spare space with conductive material so that the spare space between the outermost coil pattern and the first coil pattern is not formed.

Put another way, the outermost coil pattern may include first and second portions. In the first portion of the outermost coil pattern, the inner surface of the outermost coil pattern may curve from being directed substantially toward the external electrode to being directed substantially parallel to the external electrode. In the second portion of the outermost coil pattern the inner surface of the outermost coil pattern may curve from being directed substantially parallel to the external electrode to being directed obliquely away from the external electrode. In this case, the gap filling portion 3 is considered part of the second portion of the outermost coil pattern. The first lead portion 13*a* may have a first portion extending from the first portion of the outermost coil pattern and a second portion extending from the second portion of the outermost coil pattern.

An insulating wall 41 may be disposed between adjacent coil patterns. Since the width of the space therebetween is constantly maintained, the insulating wall filled in the space may have a substantially uniform width. The thickness of the insulating wall 41 may be substantially equal to or thicker than that of the coil pattern adjacent thereto. The surfaces of the insulating wall that would otherwise be in contact with the magnetic material (e.g., upper and side surfaces thereof) may be enclosed by an insulator 42. The insulator 42 may also cover the surfaces of the coil patterns that are not insulated by the insulating wall, to thereby insulate the coil patterns from the magnetic material. The insulator may be formed of a different material from that of the insulating wall. The material of the insulator is not limited, and may be a material applied by chemical vapor deposition. For example, the insulator may contain a parylene resin.

The coil pattern is described in more detail below with reference to FIG. 3. The line widths of each of the plurality of coil patterns may be maintained to be substantially equal to each other. The method by which the coil patterns have uniform line widths is not limited and may be, for example, laminating a photosensitive insulating material, exposing and developing the laminated photosensitive insulating material to secure an insulating wall 41 having an opening pattern, and then filling a coil material in the opening pattern may be used. It may be appreciated that the spaced width dl between the outermost coil pattern 131*a* and the first coil pattern 131*b* adjacent thereto among the plurality of coil patterns is substantially equal to a spaced width between other coil patterns. The width dl may be constant along the thickness direction and thus not decrease or increase from a lower portion of the coil pattern to an upper portion thereof. Widths may be considered substantially equal when the degree of increase or decrease in width, in the thickness direction from the lower portion of the coil pattern to the upper portion thereof, does not exceed about 5 μm. The spare space into which the magnetic particles may infiltrate between the outermost coil pattern and the first coil pattern adjacent thereto may thus be removed, thereby removing the risk that magnetic particles will damage the insulating material attached to an outer surface of the coil pattern and cause insulation breakdown and a resulting short-circuit.

Figure 4:
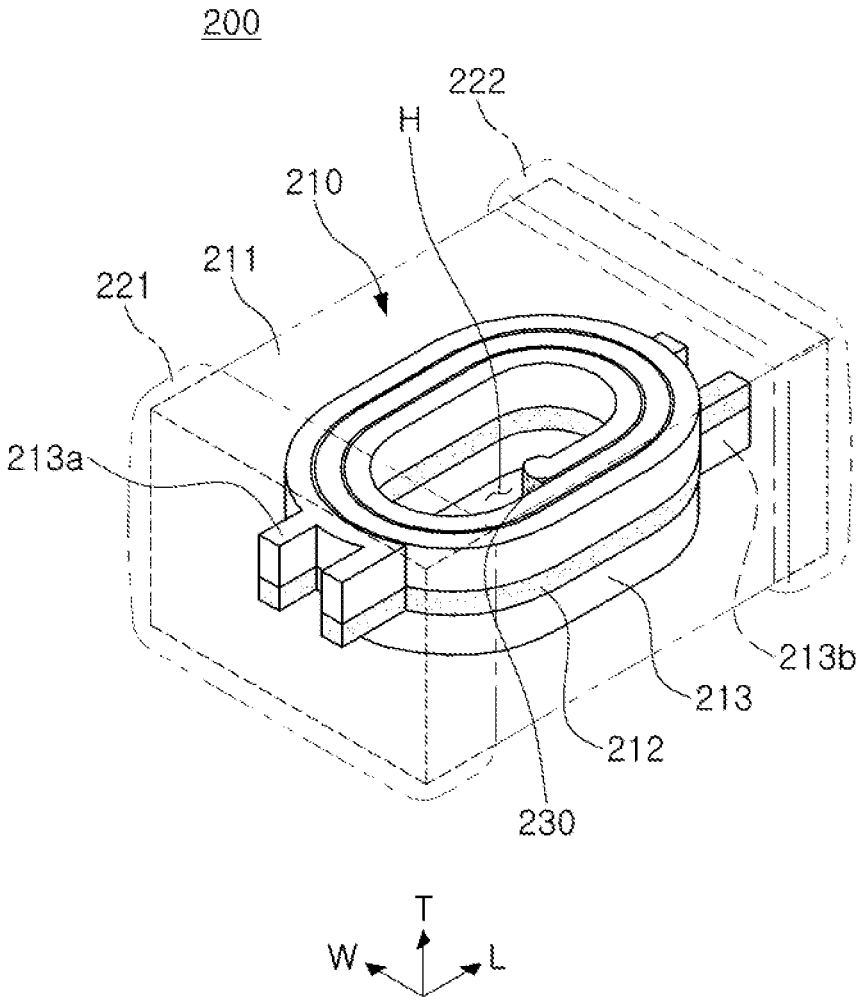
FIG. 4 is a schematic perspective view of a coil component according to a second exemplary embodiment in the present disclosure.
Figure 5:
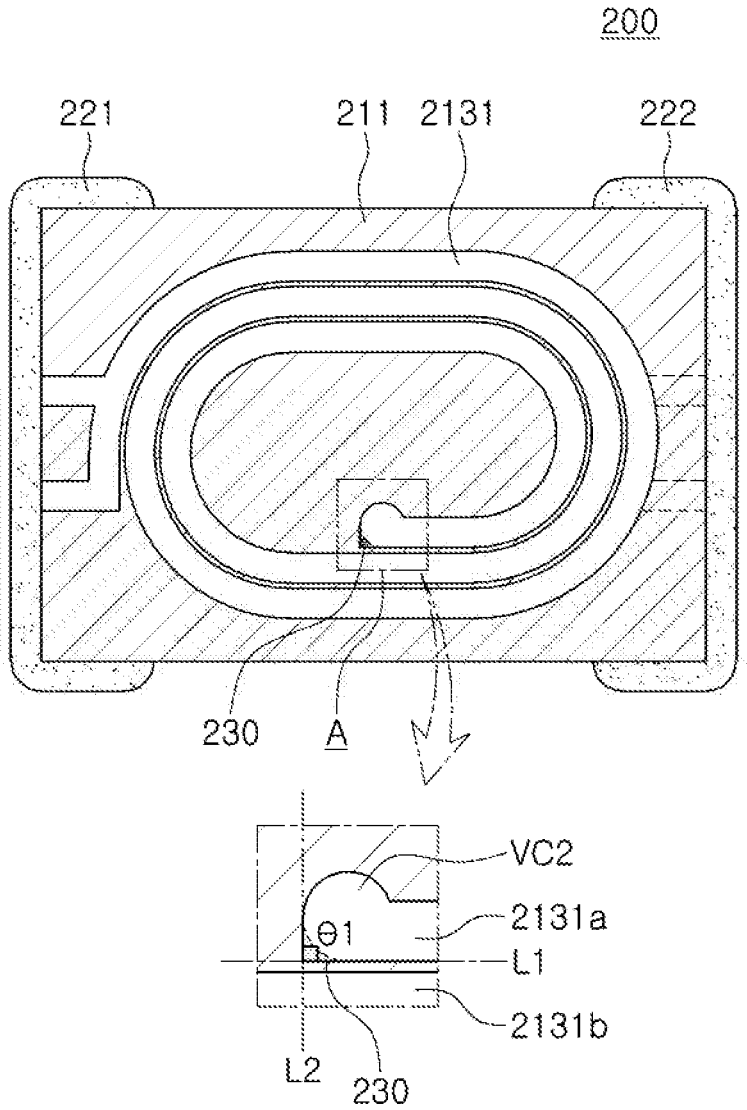
FIG. 5 is a schematic plan view of a coil pattern of the coil component of FIG. 4, based on a plane in a length-width (L-W) direction.

FIG. 4 is a schematic perspective view of a coil component 200 according to a second exemplary embodiment in the present disclosure. FIG. 5 is a schematic plan view of a coil of the coil component of FIG. 4, based on a plane in a length-width (L-W) direction. For convenience of explanation, aspects that differ from those in the coil component 100 according to the first exemplary embodiment described above will be described and overlapping descriptions may be omitted. The coil component 200 may be structurally different from the coil component 100 in that a gap filling portion 230 is further included in a through via VC2 connected to an innermost coil pattern among the plurality of coil patterns.

The coil component 200 may include a body 210 containing a magnetic material 211 and first and second external electrodes 221 and 222 disposed on outer surfaces of the body.

The gap filling portion 230 may be formed of a conductive material, and may be formed integrally with the through via VC2. Referring to FIGS. 4 and 5, in the through via VC2, a first edge L1 of the innermost coil pattern facing a first coil pattern 2131*b* most adjacent to the through via and a second edge L2 of the through via directly connected to the first edge L1 of the innermost coil pattern may form an angle θ1 that may be a substantially right angle. The second edge L2 of the through via may be an edge of the gap filling portion 230. The gap filling portion may be formed integrally with the through via and not physically distinguished from the through via, such that the gap filling portion amounts to a portion of the through via. Conventionally, the cross section of the through via, based on a plane in a L-W direction, has a circular shape, and thus has an angle corresponding to the angle θ1 that is an obtuse angle larger than 90°. Without a gap filling portion, there may be a high possibility of magnetic particles infiltrating into a spare space between the through via and a first coil pattern. For example, when a cross section of the through via is a circle and there is no gap filling portion, magnetic particles may infiltrate into the space between the through via and the first coil pattern adjacent thereto.

In the coil component 200, because the angle θ1 is 90°, there may be no space into which magnetic particles may infiltrate. Therefore, the possibility that magnetic particles will infiltrate between the coil patterns to cause insulation breakdown and generate a short-circuit, during manufacturing or use, may be substantially removed.

As long as the angle θ1 between a first edge L1 of the innermost coil pattern facing the first coil pattern most adjacent thereto and a second edge L2 of the through via directly connected to the first edge L1 of the innermost coil pattern is equal to or less than 90°, the through via may have any cross sectional shape. The cross-sectional shape of the through via is not limited to a specific cross sectional shape. When the corresponding portion of the through via is straight line, there is no doubt which portion is considered as the second edge L2 of the through via. But when the corresponding portion of the through via is curved, a line tangent to the curved portion may be considered as the second edge L2.

Figure 6A:
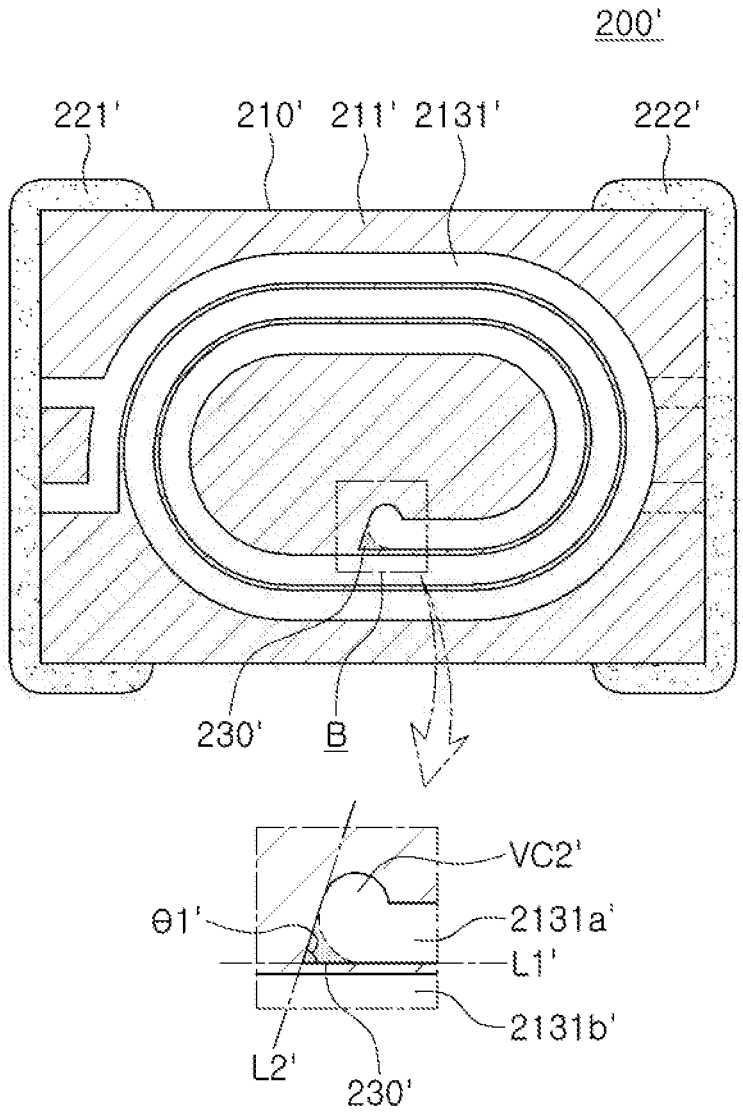
FIG. 6A is a plan view of a through via according to a first modified example of FIG. 5.
Figure 6B:
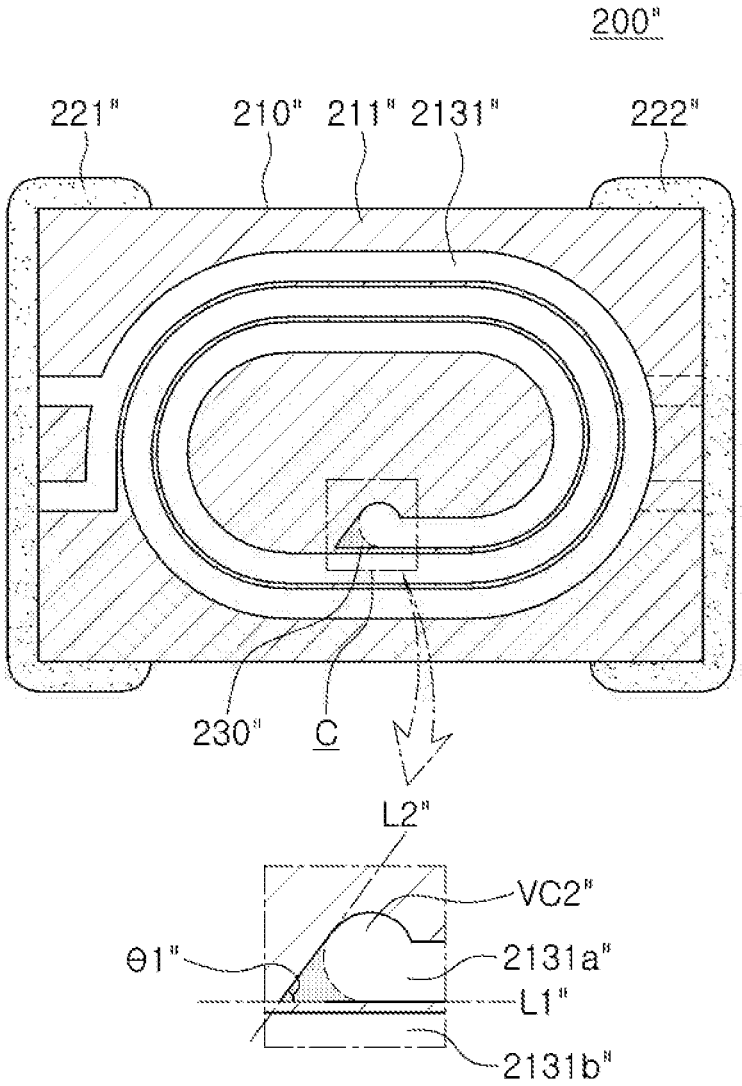
FIG. 6B is a plan view of a through via according to a second modified example of FIG. 5.

For example, the through via of FIG. 5 may be changed to through vias having cross sectional shapes illustrated in FIG. 6A or 6B. For convenience of explanation, a description of aspects of FIGS. 6A and 6B that correspond to those of FIG. 5 is omitted.

Referring to FIG. 6A, in an enlarged view of part B of a coil component 200', an angle θ1' between a first edge L1' of an innermost coil pattern facing a first coil pattern 2131*b'* most adjacent thereto and a second edge L2' of a through via directly connected to the first edge L1' may be an acute angle smaller than 90°. In FIG. 6A, the cross-sectional area of the through via is less than that of the through via illustrated in FIG. 5, which is advantageous because it may prevent the over-plating that frequently occurs in the vicinity of the through via. In FIG. 6A, a through via VC2' may include a gap filling portion 230'.

Referring to FIG. 6B, similar to the coil component 200' illustrated in FIG. 6A, an angle θ1" between a first edge L1" of an innermost coil pattern 2131*a"* facing a first coil pattern 2131*b"* most adjacent thereto and a second edge L2" of a through via VC2" directly connected to the first edge L1" of the innermost coil pattern 2131*a"* may be equal to or smaller than 90°. But the coil component 200" of FIG. 6B differs from the coil component 200' of FIG. 6A in that the length of the through via is extended. The cross sections of the through vias illustrated in FIGS. 5, 6A, and 6B are indicated by a dotted line. Referring to the enlarged view of part C of FIG. 6B, even when the through via VC2" has the cross sectional shape illustrated in FIG. 6B, the possibility that magnetic particles will infiltrate into a spare space between the through via and the first coil pattern 2131*b"* may be removed by the gap filling portion 230", such that reliability of the coil component may be improved.

Figure 7:
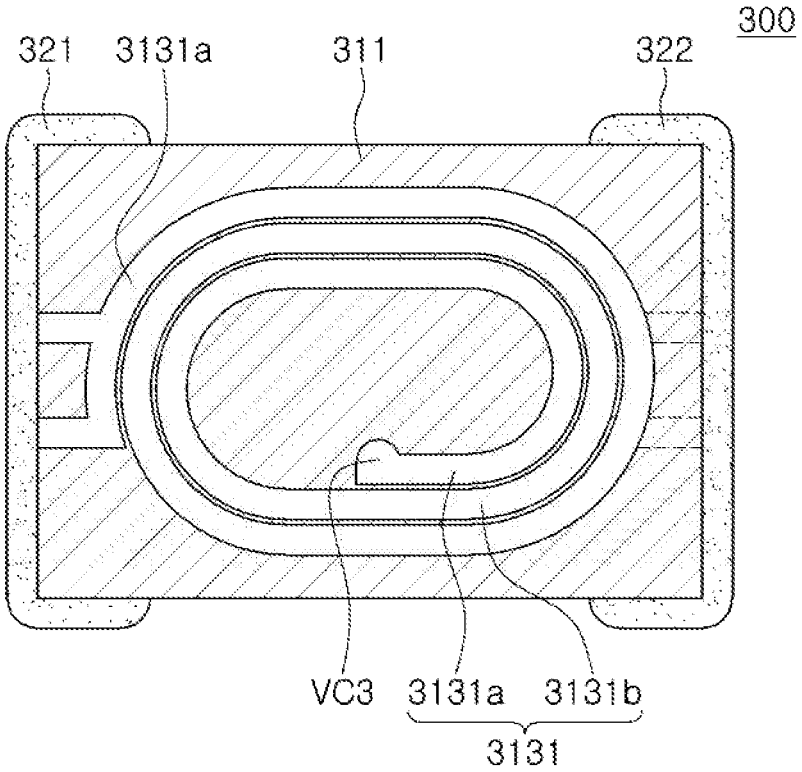
FIG. 7 is a plan view of a coil pattern of a coil component according to a third exemplary embodiment in the present disclosure, based on a plane in a length-width (L-W) direction.

FIG. 7 illustrates a combination of the lead portion illustrated in FIGS. 1 through 3 and the through via illustrated in FIGS. 4 and 5. Accordingly, for convenience of explanation, overlapping descriptions are omitted below. In the coil component 300 according to the third exemplary embodiment, problems such as reliability deterioration due to insulation breakdown caused by infiltration of magnetic particles may be prevented both in the vicinity of the lead portion and in the vicinity of the through via, and thus the coil component 300 may have excellent reliability.

Figure 8:
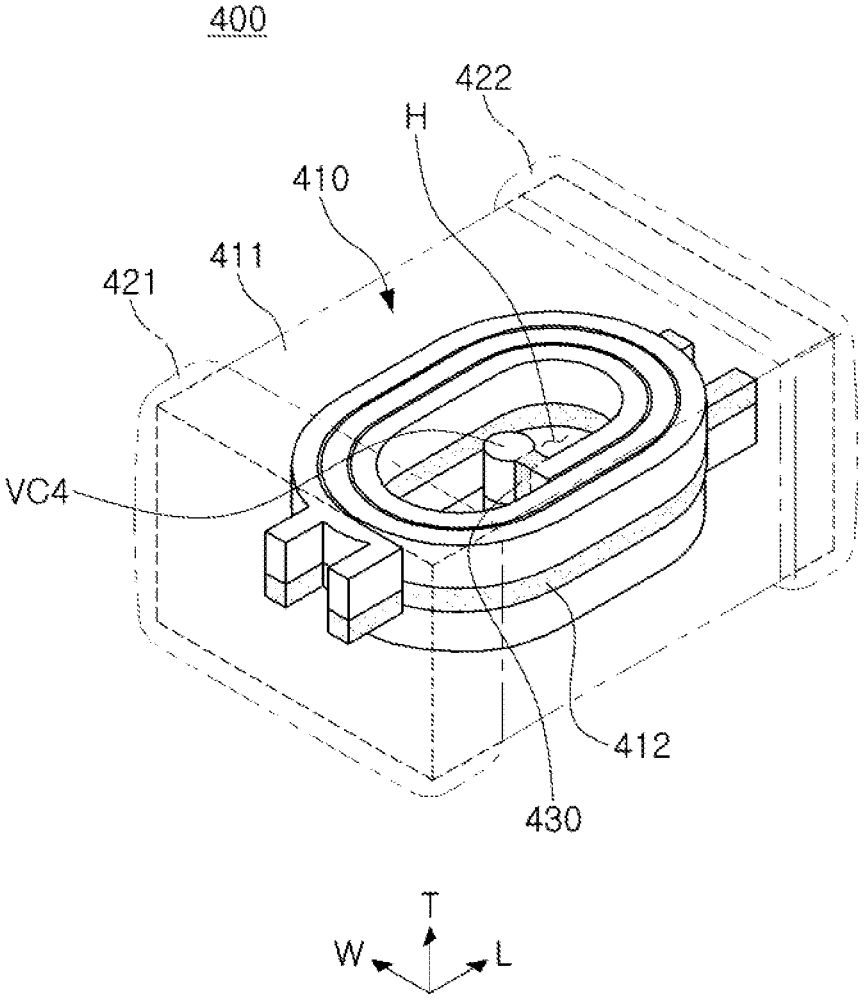
FIG. 8 is a schematic perspective view of a coil component according to a fourth exemplary embodiment in the present disclosure.
Figure 9:
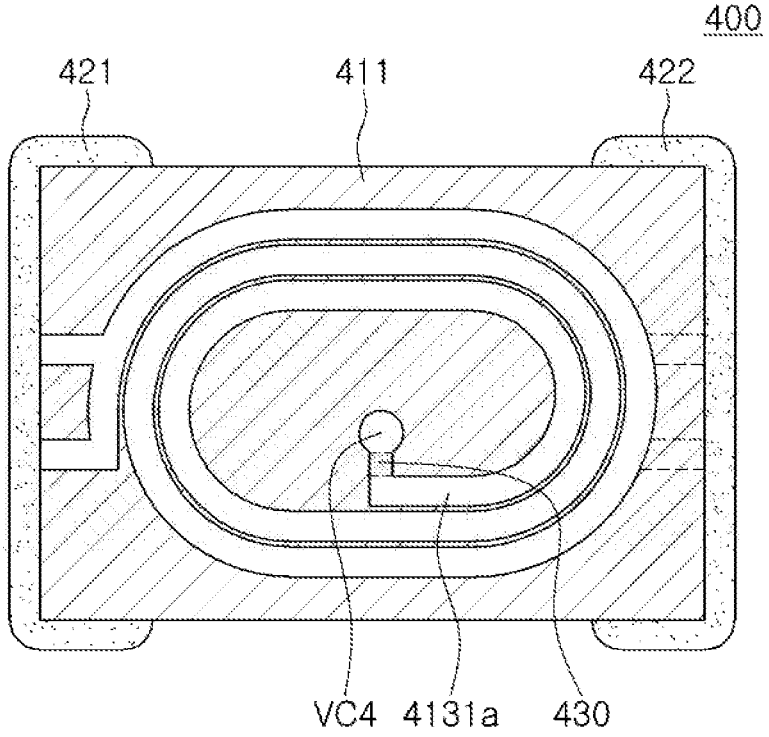
FIG. 9 is a schematic plan view of coil pattern of the coil component of FIG. 8, based on a plane in a length-width (L-W) direction.

FIG. 8 is a schematic perspective view of a coil component 400 according to a fourth exemplary embodiment in the present disclosure. FIG. 9 is a schematic plan view of coil pattern of the coil component of FIG. 8, based on a plane in a length-width (L-W) direction. The coil component 400 may include a body 410 containing a magnetic material 411 and first and second external electrodes 421 and 422 disposed on outer surfaces of the body.

Referring to FIG. 8, a through via VC4 may extend from an innermost coil pattern 4131*a* and may protrude toward a central portion of a coil. The through via VC4 may include a gap filing portion 430, which may extend perpendicularly from the innermost coil pattern. When the through via VC4 protrudes toward the central portion of the coil in a winding direction of the coil as described above, the risk that insulation breakdown will occur during manufacturing or use may be decreased. The length, angle, or the like, of the protrusion is not particularly limited, and the through via may protrude at a length or angle in consideration of the diameter of the magnetic particles in the body such that insulation breakdown caused by those magnetic particles may be prevented. The length or angle of the protrusion of the through via may be determined by an length or an angle of the extension of the gap filling portion.

With the above-mentioned coil components 100 to 400, the risk of damage to the insulating material between coil patterns or between a coil pattern and the magnetic material may be removed. As a result, the reliability of the coil component may be significantly improved.

As set forth above, according to exemplary embodiments in the present disclosure, undesired reliability deterioration problems such as damage to an insulator due to infiltration of magnetic particles between coil patterns, or the like, may be prevented by changing the structure of the coil pattern in the vicinity of the lead portion of the coil pattern or the structure of the through via.

While exemplary embodiments have been shown and described above, it will be apparent to those skilled in the art that modifications and variations could be made without departing from the scope of the present invention as defined by the appended claims.

What is claimed is:

1. A coil component comprising:

a plurality of coil patterns connected to each other to form a spiral shape;

a support member supporting the plurality of coil patterns;

a lead portion directly connected to an end portion of an outermost coil pattern of the plurality of coil patterns;

a gap filling portion containing a conductive metal and at a distal end of the outermost coil pattern; and an external electrode connected to the lead portion, wherein the gap filling portion is spaced apart from an inward coil pattern by a first distance, the outermost coil pattern is spaced apart from the inward coil pattern by a second distance, and the first distance is substantially equal to the second distance, wherein the lead portion includes an opening filled with a magnetic material, and wherein the support member includes a first through hole overlapping the opening in a thickness direction.

2. The coil component of claim 1, wherein the gap filling portion is integral with the outermost coil pattern.

3. The coil component of claim 1, further comprising:

an insulating wall between the plurality of coil patterns.

4. The coil component of claim 3, further comprising:

an insulator on an upper surface of the insulating wall.

5. The coil component of claim 1, wherein in a region in which the lead portion and the outermost coil pattern are connected to each other, a spaced distance between the outermost coil pattern and a coil pattern most adjacent thereto is substantially constant along a winding direction of the plurality of coil patterns.

6. The coil component of claim 1, wherein the support member includes a second through hole in a center thereof.

7. The coil component of claim 6, wherein the second through hole is filled with the magnetic material.

8. The coil component of claim 1, wherein a radius of curvature of the outermost coil pattern is substantially constant in a winding direction of the plurality of coil patterns.

9. A coil component comprising:

a plurality of coil patterns connected to each other to form a spiral shape;

a support member supporting the plurality of coil patterns;

a lead portion connected to an end portion of a coil pattern of the plurality of coil patterns, wherein the lead portion includes an opening filled with a magnetic material;

a through via directly connected to an innermost coil pattern of the plurality of coil patterns; and a gap filling portion containing a conductive material and at the through via, wherein the gap filling portion is spaced apart from an outward coil pattern by a first distance, the innermost coil pattern is spaced apart from the outward coil pattern by a second distance, and the first distance is substantially equal to the second distance, and wherein the support member includes a first through hole overlapping the opening in a thickness direction.

10. The coil component of claim 9, wherein the gap filling portion is integral with the through via.

11. The coil component of claim 9, wherein in a plane in a length-width (L-W) direction parallel to the spiral shape of the coil patterns, an angle between one edge of the innermost coil pattern facing a coil pattern adjacent thereto and an outermost edge of the gap filling portion is equal to or less than 90°.

12. The coil component of claim 9, further comprising:

an insulating wall between the plurality of coil patterns.

13. The coil component of claim 9, wherein the support member includes a second through hole in a center thereof.

14. The coil component of claim 13, wherein the second through hole is filled with the magnetic material.

15. A coil component, comprising:

a plurality of coil patterns connected to each other to form a spiral shape;

a support member supporting the plurality of coil patterns;

a lead portion connected to an end portion of a coil pattern of the plurality of coil patterns, wherein the lead portion includes an opening filled with a magnetic material;

a through via spaced apart from and electrically connected to an innermost coil pattern of the plurality of coil patterns; and a gap filling portion containing a conductive material, in between and connecting the through via to the innermost coil pattern, wherein the gap filling portion is perpendicular to the innermost coil pattern, and wherein the support member includes a through hole overlapping the opening in a thickness direction.

16. The coil component of claim 15, wherein a line width of the gap filling portion is the same as that of the innermost coil pattern.

17. A coil component, comprising:

a lead portion;

an external electrode connected to the lead portion; and a plurality of coil patterns disposed on a support member and connected to each other to form a spiral shape, including an outermost coil pattern with a curved portion that includes:

a first curved portion where the inner surface of the outermost coil pattern curves from being directed substantially toward the external electrode to being directed substantially parallel to the external electrode, and a second curved portion where the inner surface of the outermost coil pattern curves from being directed substantially parallel to the external electrode to being directed obliquely away from the external electrode, wherein the lead portion is directly connected to the curved portion of the outermost coil pattern, wherein the lead portion includes an opening filled with a magnetic material, and wherein the support member includes a through hole overlapping the opening in a thickness direction.

18. The coil component of claim 17, wherein the lead portion comprises a first lead portion extending from the first curved portion of the curved portion to the external electrode and a second lead portion extending from the second curved portion of the curved portion to the external electrode, and wherein the first and second lead portions are spaced apart from each other.

19. The coil component of claim 17, further comprising:

an inward coil pattern adjacent to and spaced apart from the outermost coil pattern, wherein a first distance between the first curved portion and the inward coil pattern is substantially equal to a second distance between a distal end of the second curved portion and the inward coil pattern.

20. The coil component of claim 17, further comprising:

an inward coil pattern adjacent to and spaced apart from the outermost coil pattern, wherein a space between the inward coil pattern and a distal end of the second curved portion is substantially filled by an insulating material.

21. A coil component, comprising:

a plurality of coil patterns connected to each other to form a spiral shape, including an innermost coil pattern and an outward coil pattern adjacent to and spaced apart from the innermost coil pattern;

a support member supporting the plurality of coil patterns;

a lead portion connected to an end portion of a coil pattern of the plurality of coil patterns, wherein the lead portion includes an opening filled with a magnetic material; and a through via directly connected to the innermost coil pattern, wherein the through via has a shape including a first side substantially parallel to the outward coil pattern, a second side connected to the first side and at an angle to the first side equal to or less than 90°, and a curved side, and wherein the support member includes a through hole overlapping the opening in a thickness direction.

22. The coil component of claim 21, wherein the angle is substantially 90° and the curved side has a substantially constant radius of curvature.

23. The coil component of claim 21, wherein the angle is less than 90° and the curved side has a radius of curvature that varies.

24. The coil component of claim 21, wherein a space between the outward coil pattern and the through via where it forms the angle is substantially filled by an insulating material.

* * * * *